United States Patent [19]

Shifferaw

[11] Patent Number: 4,790,596

[45] Date of Patent: Dec. 13, 1988

[54] RESILIENT CHAIR

[76] Inventor: Tessema D. Shifferaw, 1856 Carlson, Richmond, Calif. 94804

[21] Appl. No.: 67,314

[22] Filed: Jun. 26, 1987

[51] Int. Cl.[4] ..... A47C 3/00

[52] U.S. Cl. ..... 297/287; 297/290; 297/259; 297/258; 248/628

[58] Field of Search ..... 297/259, 258, 287, 286, 297/290; 248/626, 628, 627

[56] References Cited

U.S. PATENT DOCUMENTS

| | | | |
|---|---|---|---|
| D. 141,551 | 6/1945 | Edelson | 297/287 X |
| 1,998,089 | 4/1935 | Larsen | 297/286 |
| 2,063,780 | 12/1936 | Ball | 297/290 |
| 2,097,884 | 11/1937 | Karn | 297/287 |
| 2,264,143 | 11/1941 | Scott et al. | 248/627 |
| 2,303,039 | 11/1942 | Gilkison | 297/287 X |
| 2,592,756 | 8/1952 | Spence | 297/287 |
| 2,714,417 | 8/1955 | Golding | 248/626 |
| 2,718,916 | 9/1955 | Borochoff | 297/287 |

FOREIGN PATENT DOCUMENTS

| | | | |
|---|---|---|---|
| 3031881 | 3/1982 | Fed. Rep. of Germany | 297/259 |
| 323051 | 12/1929 | United Kingdom | 248/628 |

*Primary Examiner*—Francis K. Zugel

*Attorney, Agent, or Firm*—Flehr, Hohbach, Test, Albritton & Herbert

[57] ABSTRACT

Chair having a frame formed of resilient rods bent to a U-shaped configuration for resiliently supporting a person sitting on the chair.

13 Claims, 1 Drawing Sheet

RESILIENT CHAIR

This invention pertains generally to chairs, and more particularly to a chair having a resilient frame.

Heretofore, chairs have been provided in a wide variety of different styles and shapes for use in different situations. In many instances, the design of a chair is determined largely by aesthetic considerations, rather than the comfort of a person sitting in the chair.

It is in general an object of the invention to provide a new and improved chair which is both aesthetically pleasing and comfortable for the person sitting therein.

Another object of the invention is to provide a chair of the above character which can be manufactured economically.

These and other objects are achieved in accordance with the invention by providing a chair having a frame comprising a pair of elongated resilient rods bent to a U-shaped configuration, with a seat resiliently supported by the rods for receiving a person sitting on the chair. The rods are highly resilient and will return to a straight condition if not restrained. Means is connected to the rods for preventing them from straightening beyond the U-shape while permitting them to flex when a person sits on the chair.

Figure 1:
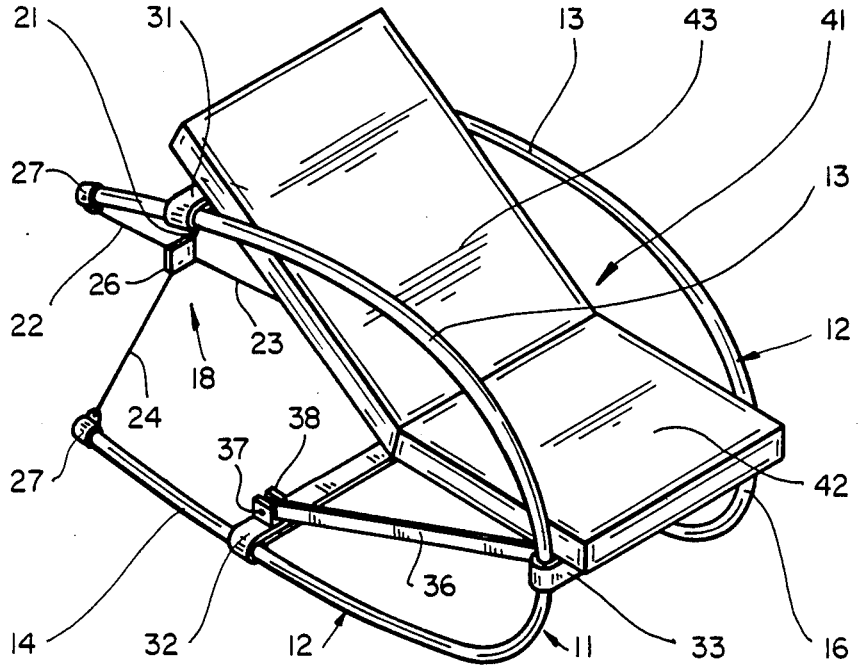
FIG. 1 is an isometric view of one embodiment of a chair according to the invention.
Figure 2:
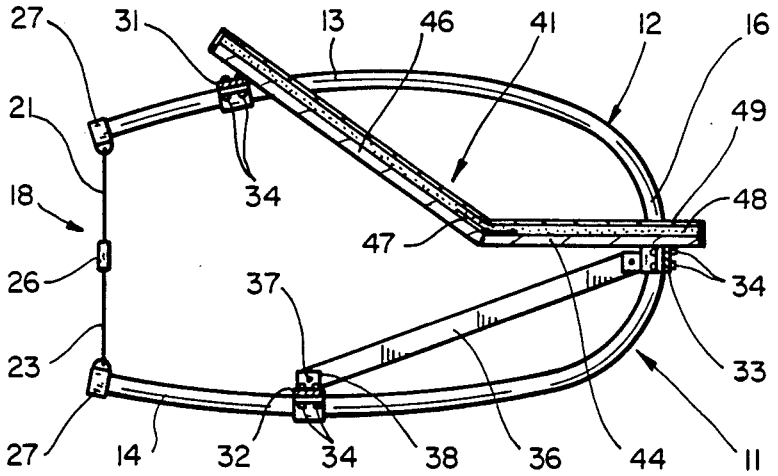
FIG. 2 is a vertical sectional view of the embodiment of FIG. 1.

As illustrated in FIG. 1, the chair comprises a resilient frame 11 having a pair of generally U-shaped side members 12. Each of the side members has an upper horizontally extending arm section 13, a lower horizontally extending arm section 14, and a curved section 16 between the arm sections.

Each of the side members comprises an elongated rod of resilient material such as nylon which is bent to the U-shaped configuration without heating or other treatment which would permanently alter the shape of the rod. If unrestrained, the rods will return to a straight configuration or condition.

The stiffness of the rods, and therefore the stiffness of the support provided by the chair, is largely dependent upon the dimensions and the elastic properties of the rods. In one presently preferred embodiment, the rods are nylon rods of circular cross section with a diameter on the order of $\frac{3}{4}$ inch. Heavier rods can be used for a stiffer support, and lighter rods can be used for a more flexible support. The rods can have any other suitable cross-sectional configuration (e.g. rectangular), and two or more of the rods can be clamped together for greater stiffness.

Means is provided for preventing the rods from straightening beyond the U-shaped configuration, while permitting them to flex in response to the weight of a person sitting on the chair. In the embodiment of FIG. 1, this means comprises a harness assembly 18 which is connected to the ends of the rods at the rear of the chair. This assembly includes flexible cables 21–24 which extend between a hub member 26 and the respective ends of the rods. The outer ends of the cables are connected to brackets 27 which are affixed to the end portions of the rods. The harness assembly thus provides a cross-connection which ties the rods on the two sides of the chair together in addition to retaining each of the rods in the U-shaped configuration.

Cross members 31, 32 and 33 extend between the side members of the frame. Cross member 31 extends between the upper arm sections, cross member 32 extends between the lower arm sections, and cross member 33 extends between the curved sections at the front of the chair. Each of the cross members comprises a rigid bar, with the ends of the bars being wrapped about the rods and clamped by bolts 34 to secure the cross members to the rods.

Stabilizer bars 36 extend between front cross member 33 and lower cross member 32 at the sides of the chair. These bars are pivotally connected to the cross members by pins 37 mounted in brackets 38 affixed to the cross members.

A seat assembly 41 is mounted on frame 11 for receiving the body of a person sitting on the chair. This assembly includes a seat 42 which extends in a generally horizontal direction about midway between the upper and lower arms of frame members 12 and an inclined back rest 43 which extends upwardly and rearwardly from the seat. The seat has a rigid board 44, the front portion of which rests upon the front cross member 33 of the frame, and the back rest has a rigid board 46 which rests against the upper cross member 31. The rear edge of the seat board and the lower edge of the back board are joined pivotally together by hinges 47 to permit the angle between the back rest and the seat to vary as the frame flexes in response to the weight of a person sitting on the chair. The seat board and the back board are connected to the cross members to secure the seat assembly and the frame together. These connections can be either fixed connections or pivoting connections, as desired.

A cushioning pad 48 overlies the seat board and the back board and is covered by a layer of upholstery material 49. The pad can be fabricated of any suitable cushioning material such a polyurethane foam, and the upholstery can be any suitable material such as vinyl or a suitable fabric.

In use, the lower arms 14 of the side frame members rest upon the floor or other supporting surface on which the chair is placed. When no one is sitting on the chair, the cables in harness assembly 18 are pulled taut, and they prevent the resilient rods which form the side frame members 12 from extending beyond the U-shaped configuration. When a person sits upon the chair and leans against back rest 43, the upper arms 13 of the U-shaped rods are deflected in a downward direction, and the cables are relaxed. As long as the person remains on the chair and the cables are relaxed, the rods are free to flex in either an upward direction or a downward direction in accordance with the bending force exerted on the rods.

The size and hence the resiliency of the rods which form the side frames can be selected to provide any desired degree of flexibility or stiffness in the support provided by the chair. The rods can also be sized in accordance with the weight of the person using the chair.

Figure 3:
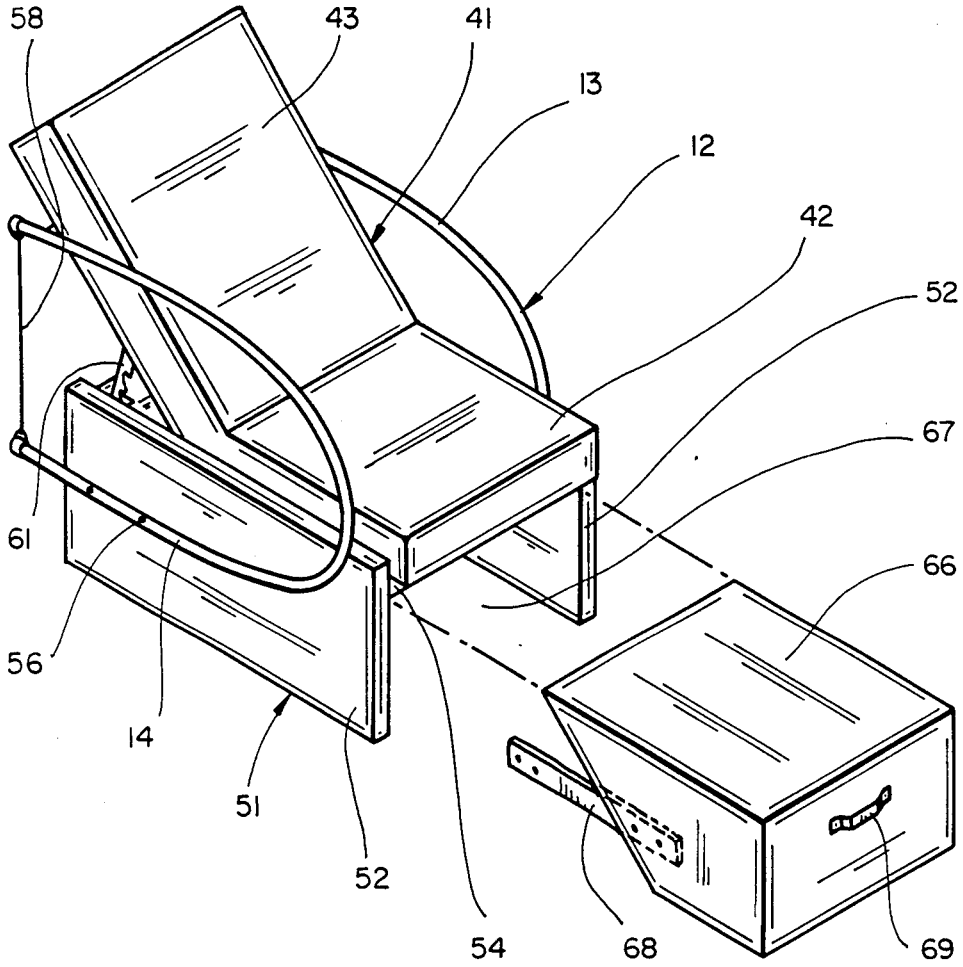
FIG. 3 is an exploded isometric view of a second embodiment of chair according to the invention.
Figure 4:
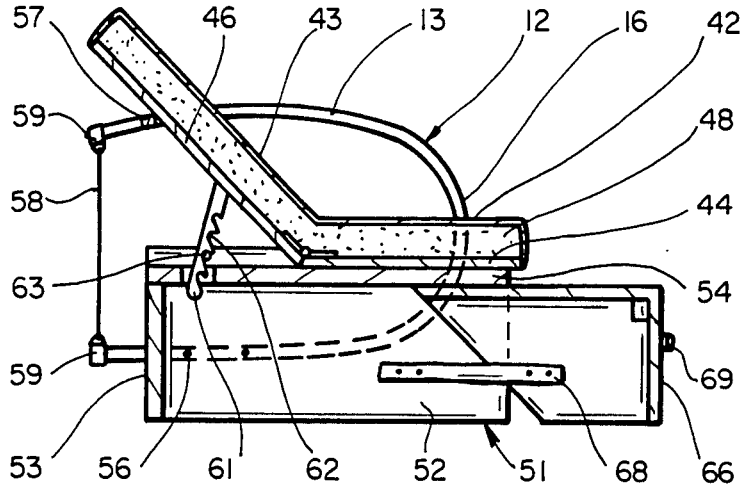
FIG. 4 is a vertical sectional view of the embodiment of FIG. 3.

In the embodiment of FIG. 3, the chair has side frames 12 and a seat assembly 41 similar to the side frames and seat assembly in the embodiment of FIG. 1. In this embodiment, however, the side frames and the seat assembly are mounted on a generally rectangular base 51. The base has a pair of upstanding side members 52, a rear member 53, and a platform member 54 which is recessed somewhat below the top edges of the side members. The lower arms 14 of the U-shaped rods are affixed to side members 52 by bolts 56, and seat board 44 rests on and is secured to platform member 54. Seat back 46 rests against a cross member 57 which extends between upper arms 13 toward the rear of the chair. The back board is free to slide on the cross member as the rods flex. The rods are retained in the U-shaped configuration by cables 58 which extend directly between the upper and lower ends of the respective rods. The cables are connected to the rods by means of brackets 59 which are affixed to the ends of the rods.

In the embodiment of FIG. 3, means is provided for supporting back 43 in a fixed position if a rigid back support is desired. This means includes a pair of braces 61 which are pivotally mounted on the seat back and have a plurality of notches 62 for selective engagement with pins 63 carried by the side members of the base.

The embodiment of FIG. 3 also includes a foot stool 66 which can be extended and retracted through an opening 67 at the front of base 51. Flexible straps 68 are connected between the foot stool and the base to limit the forward travel of the foot stool, and a handle 69 is provided on the front of the foot stool.

In use, base 51 rests on the floor or other supporting surface, and foot stool 66 can be extended or retracted as desired. If a flexible back support is desired, braces 61 are disengaged from pins 63, and the back of the chair is free to move with the resilient rods. If a rigid support is desired, the braces are engaged with the pins to support the back at the desired angle.

Figure 5:
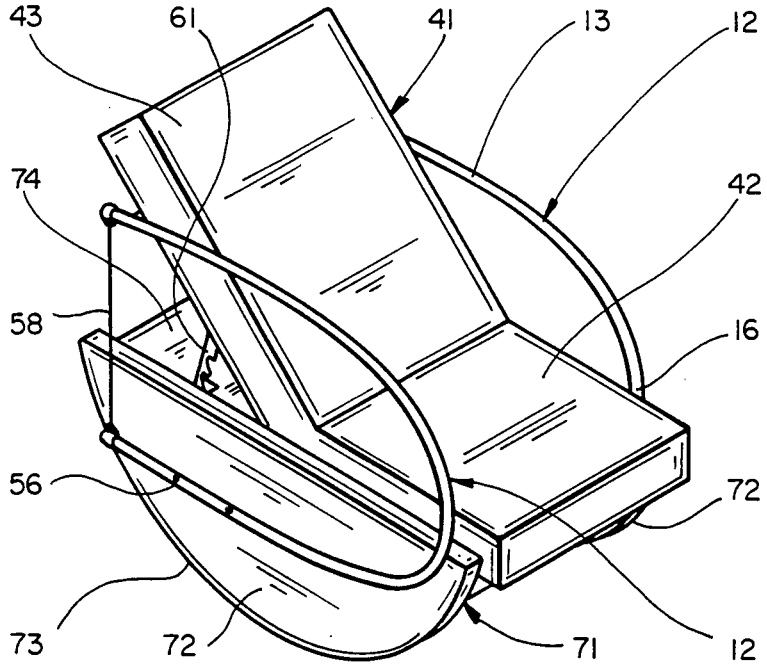
FIG. 5 is an isometric view of a third embodiment of a chair according to the invention.

The embodiment of FIG. 5 is generally similar to the embodiment of FIG. 3 except it has a rocking base 71 instead of the stationary base 51. Like reference numerals designate corresponding elements in these two embodiments.

Base 71 comprises a pair of side members 72 with curvilinear lower surfaces 73 for rocking engagement with the floor or other supporting surface. A platform member 74 extends between the upper portions of the side members, and cross bracing (not shown) extends between the lower portions of the side members. The lower arms 14 of the U-shaped rods are bolted to the side members of the base, as in the embodiment of FIG. 3, and the seat board is mounted on the platform. Also as in the embodiment of FIG. 3, braces 61 are provided for securing the seat back at a predetermined angle if a rigid support is desired.

The invention has a number of important features and advantages. The chair is extremely comfortable to sit in, and it can be adapted for use in a wide variety of situations. It is easily constructed, and the resilient rods can be selected to provide any degree of stiffness or flexibility desired.

It is apparent from the foregoing that a new and improved chair has been provided. While only certain preferred embodiments have been described in detail, as will be apparent to those familiar with the art, certain changes and modifications can be made without departing from the scope of the invention as defined by the following claims.

I claim:

1. In a chair: a plurality of elongated resilient rods which will return to a substantially straight condition if unrestrained, each of said rods being bent to a U-shaped configuration with upper and lower horizontally extending sections, retaining means for preventing the rods from straightening beyond the U-shaped configuration, and means mounted on the rods and resiliently supported thereby for receiving a person sitting on the chair.

2. The chair of claim 1 wherein the means for receiving the person includes a seat and a back rest joined hingedly together for pivotal movement relative to each other upon flexing of the rods.

3. The chair of claim 1 wherein the lower horizontally extending section of each of the rods rests on the floor.

4. The chair of claim 1 together with a rigid base on which the U-shaped rods are mounted with the upper sections of each of the rods being free to move relative to the base as the rods flex, the means for receiving the person being connected to the upper sections of the rods.

5. The chair of claim 4 wherein the base has a curvilinear lower surface which rests upon the floor and supports the chair for rocking movement relative to the floor.

6. The chair of claim 4 including means selectively engageable between the means for receiving the person and the base for holding the latter means in a fixed position relative to the base when engaged.

7. The chair of claim 1 wherein the retaining means comprises flexible cables connected between the horizontally extending sections of the rods.

8. The chair of claim 7 wherein the cables are cross-connected between the ends of the two rods.

9. In a chair: a plurality of elongated resilient rods which will return to a substantially straight condition if not restrained bent to a U-shaped configuration on opposite sides of the chair, each of said U-shaped rods having generally parallel upper and lower arms and a curved section between the arms, flexible cables connected between the ends of the rods and preventing the rods from straightening beyond the U-shaped configuration, a seat extending between the curved sections of the rods, a back rest extending between the upper arms of the rods, and means hingedly connecting the seat and the back rest together for pivotal movement relative to each other upon flexing of the rods.

10. The chair of claim 9 including a first cross member connected between the curved sections of the rods, a second cross member connected between the upper arms of the rods, and means mounting the seat and the back rest on the cross members.

11. The chair of claim 10 wherein the cross members are clamped to the rods.

12. The chair of claim 9 wherein the ends of the rods on opposite sides of the chair are held together by the cables.

13. The chair of claim 9 including stabilizer bars pivotally connected between the lower arms and the curved sections of the U-shaped rods.

* * * * *